US008096556B2

(12) United States Patent
Chamberlain et al.

(10) Patent No.: US 8,096,556 B2
(45) Date of Patent: Jan. 17, 2012

(54) METHOD FOR PLAYING A WAGERING GAME

(75) Inventors: Ronald Chamberlain, Lebanon, CT (US); Christopher Lewis, Guilford, CT (US)

(73) Assignee: Vegas Gaming Group, LLC, Wilmington, DE (US)

( * ) Notice: Subject to any disclaimer, the term of this patent is extended or adjusted under 35 U.S.C. 154(b) by 0 days.

(21) Appl. No.: 12/624,620

(22) Filed: Nov. 24, 2009

(65) Prior Publication Data

US 2010/0213672 A1 Aug. 26, 2010

Related U.S. Application Data

(60) Provisional application No. 61/208,187, filed on Feb. 23, 2009.

(51) Int. Cl.
*A63F 1/00* (2006.01)

(52) U.S. Cl. ..... 273/292; 463/13

(58) Field of Classification Search ..... 273/292, 273/274, 309; 463/13, 12
See application file for complete search history.

(56) References Cited

U.S. PATENT DOCUMENTS

| | | | | |
|---|---|---|---|---|
| 5,725,216 | A * | 3/1998 | Jones | 273/292 |
| 6,102,402 | A * | 8/2000 | Scott et al. | 273/292 |
| 2005/0001378 | A1 * | 1/2005 | Lo | 273/292 |

* cited by examiner

*Primary Examiner* — Benjamin Layno
(74) *Attorney, Agent, or Firm* — Raymond A. Nuzzo

(57) ABSTRACT

A method of playing a card wagering game. Each player places an ante. A first number of cards is dealt face down to each player and a dealer to form a player hand and a dealer hand. Players view their cards and decide whether to continue play or surrender. Players that surrender shall fold and forfeit their ante wager. Remaining players place a call wager to continue play. A second number of cards is dealt face down to each remaining player and the dealer so that each player and the dealer now have a hand of the first and second number of cards. If any player does not have at least a four card straight, a four card flush or a four card straight-flush that player loses his ante wager. Each player that has at least a four card straight, a four card flush or a four card straight-flush now plays against the dealer's hand. A player is paid on the player's ante and call wagers in accordance with a pay-table when the player's hand outranks the dealer's hand.

5 Claims, 7 Drawing Sheets

METHOD FOR PLAYING A WAGERING GAME

CROSS-REFERENCE TO RELATED APPLICATIONS

This application claims the benefit of the filing date of U.S. provisional application No. 61/208,187, filed Feb. 23, 2009.

TECHNICAL FIELD

The present invention generally relates a method for playing a card game.

BACKGROUND ART

Casinos and wagering establishments are always looking for new, novel and exciting card games that entice players to play such card games and hold the players' interest. New and exciting card games increase revenues to casinos and other wagering establishments. On the other hand, prospective, players are always looking for new card games that are challenging and exciting. Some examples of well know card games are Let It Ride Bonus Stud Poker, described in U.S. Pat. No. 5,288,081, Three Card Poker, described in U.S. Pat. No. 5,685,774, and Caribbean Stud Poker, described in U.S. Pat. No. 4,836,533.

DISCLOSURE OF THE INVENTION

It is an object of the present invention to provide a new method for playing cards that generates additional unpredictability, excitement, and revenue for both players and casinos in comparison to traditional card games.

Other objects and advantages of the present invention will be apparent in view of the ensuing description of the present invention.

In one aspect, the present invention is directed to a method of playing a wagering game comprising the steps of providing at least one deck of playing cards, receiving an ante wager from each player in order to participate in the wagering game, dealing a first number of cards face down to each player who places the ante wager to form a player hand, dealing the first number of cards face down to the dealer to form a dealer hand, and providing an opportunity for a player to view the player's cards so that the player may decide whether to continue play or to surrender. Any player that decides to surrender shall fold and forfeit the player's ante wager. The method of playing the wagering game further includes the step of receiving a call wager from each remaining player in order to continue to play the wagering game, dealing a second number of cards face down to each remaining player who places a call wager, wherein each player's hand is now formed by the combination of the first and second number of cards. The method of playing the wagering game further includes the steps of dealing the second number of cards face down to the dealer so that the dealer's hand is now formed by the combination of the first and second number of cards, and determining if any player does not have at least a four card straight, a four card flush or a four card straight-flush. If a player does not have at least a four card straight, a four card flush or a four card straight-flush, the player immediately loses his ante wager. However, this situation is a push to the player's call wager and so the player's call wager is returned to him. Any player who has at least a four card straight, a four card flush or a four card straight-flush plays against the dealer's hand. The method of playing the wagering game further comprises the steps of determining the ranking of the dealer's and player's hands in accordance with a predetermined ranking of hands, determining if the player's hand outranks the dealer's hand, paying each player on the ante and call wagers in accordance with a predetermined pay-table when the player's hand outranks the dealer's hand, and collecting the ante and call wagers from the players whose hands do not outrank the dealer's hand.

BEST MODE FOR CARRYING OUT THE INVENTION

Figure 1:
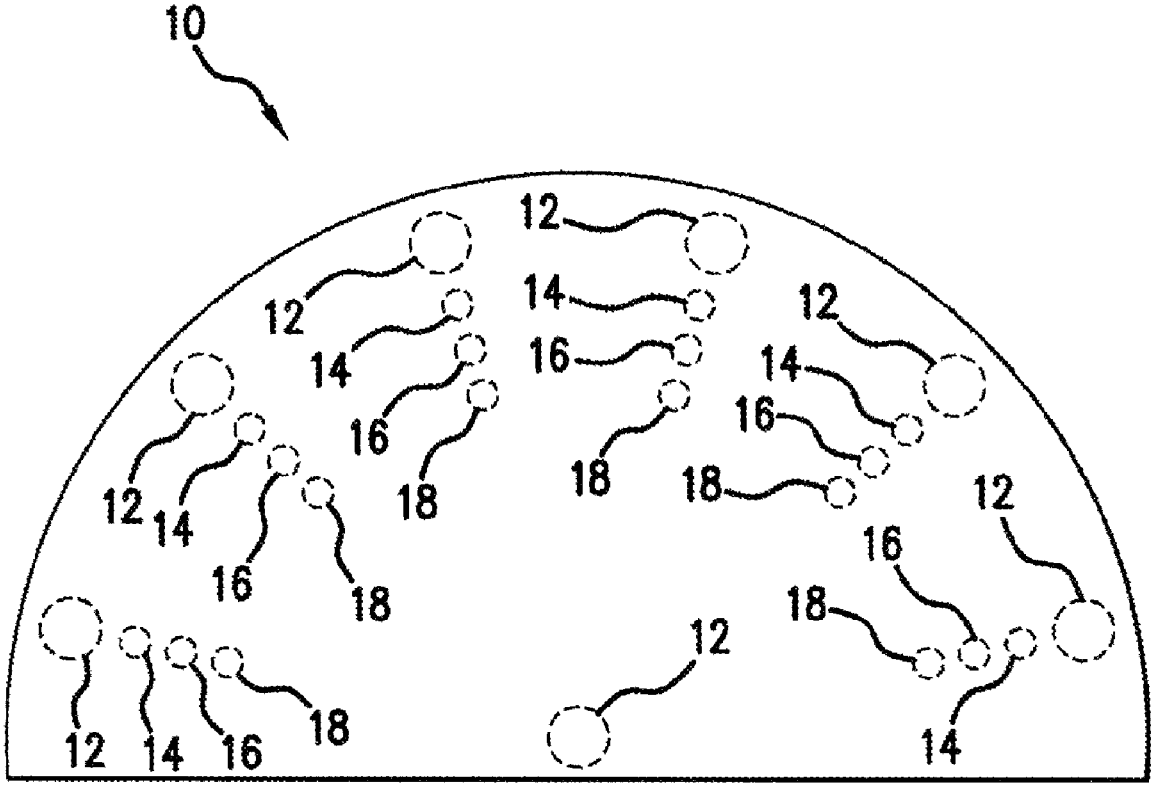
FIG. 1 is a plan view of a gaming table layout suitable for play of the wagering game of the present invention.

The card game of the present invention is played on a table by at least one player and a dealer. The card game of the present invention may be played with up to six players plus the dealer. The dealer usually represents the house or the casino in the play of the game. Referring to FIG. 1, there is shown one embodiment of a table suitable for playing the wagering game of the present invention. Table 10 has a plurality of card receiving areas 12 for the players and the dealer, and Ante wagering areas 14 for the players to place Ante wagers. Table 10 includes Call wagering areas 16 for the players to place Call wagers and Jackpot wager areas 18 for the players to place Jackpot wagers. In one embodiment, the card table may have printed thereon the appropriate payout schedule that corresponds to the wagering game of the present invention.

In one embodiment, all of the sets of cards are contained in a shoe, known in the art, from which the dealer may draw one card at a time. In another embodiment, the cards are contained in an automatic card shuffler. In order to initiate play of the game, a standard deck of fifty-two cards is provided. The game may be played with more than one standard deck of cards if the number of players requires that more than one deck of cards be used. In other forms of the game, multiple intermixed decks of cards, decks with wild cards or special decks (i.e. decks with certain cards removed) and Jokers are used.

The card game of the present invention can be implemented on an electronic gaming machine such as an electronic video gaming machine. In such electronic gaming machines, images of playing cards are electronically generated and then displayed on a display screen.

Additionally, the card game of the present invention can be realized with a lottery scratch ticket wherein images of playing cards are covered by a substance that is removed by players with a coin or other suitable object. U.S. Pat. No. 6,572,107 shows a typical structure of such lottery scratch-type tickets. Thus, the terms "cards", "playing cards" or "hand" are defined herein to include:

a) physical playing cards,
b) computer-generated images of playing cards,
c) graphically generated images of playing cards, and
d) images of playing cards formed on lottery scratch-type tickets.

The card game requires that players make two bets: (1) the ante, and (2) the call bet. In accordance with the invention, both the Ante and Call bets are mandatory. The card game also provides an opportunity for a player to make an optional Progressive Jackpot bet. If the particular embodiment of the card game of the present invention uses a Progressive Jackpot, then the players must place their jackpot bets at the same time they place their Ante wager. The jackpot bets are described separately in the ensuing description.

In the first step of the game, each player places an Ante wager before any cards are dealt. If a jackpot is being used, then any players desiring to participate in the jackpot must also place their jackpot bets when they place the Ante wager.

Next, each player and the dealer will receive four cards. The dealer preferably deals the initial four card hand in a left-to-right motion starting from the dealer's left. The cards are dealt face down. Each player then looks at his or her hand and decides if he or she wants to play or surrender. If the player decides to surrender, the player must fold his or her hand and forfeit all of his or her Ante wager. If a player does not surrender, that player must make a Call bet. In one embodiment, the Call bet is equal to the Ante. In another embodiment, the Call bet is double the Ante wager.

After a player makes the Call bet, that player will receive three additional cards facedown. The player then views his or her three additional cards and combines these additional cards with his or her initially dealt four cards in order to make a seven card hand.

The dealer will also deal himself three additional cards which he will combine with his initially dealt four cards in order to make a seven card hand.

If a player does not have at least a four-card straight, a four-card flush or a four-card straight-flush, the player immediately loses his or her Ante wager and any Jackpot wager. However, such a situation is a push to the player's Call bet and so the player's Call bet is returned to him or her.

Figure 2:
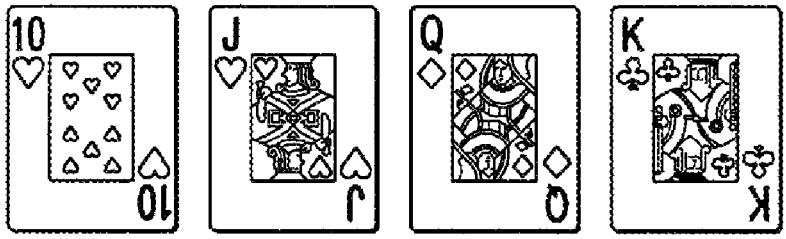
FIG. 2 illustrates a four card straight.
Figure 3:
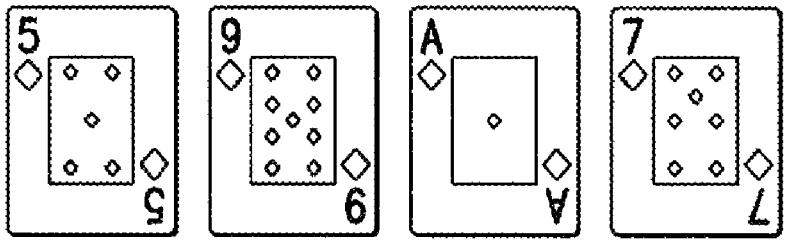
FIG. 3 illustrates a four card flush.

Examples of a four card straight and a four card flush are shown in FIGS. 2 and 3, respectively.

If a player's hand forms a four card, five card, six card or seven card straight, flush or straight-flush, then the player shall play against the dealer's hand.

Figure 4:
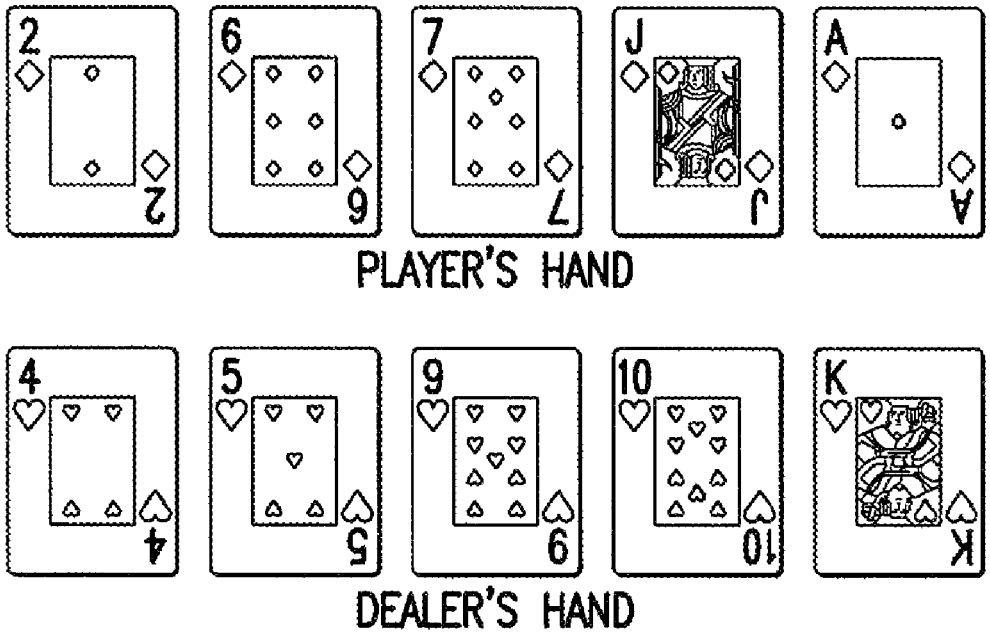
FIG. 4 illustrates both a player and the dealer having a five-card flush.

When a player's hand and the dealer's hand both have the same number of cards making up a straight, flush or straight-flush, then a straight-flush beats a flush and a flush beats a straight. Otherwise, the hand with the greater number of cards making up a straight, flush or straight-flush wins. For example, a six card straight will outrank a five card straight-flush. FIG. 4 shows an example wherein the dealer and the player each have a five card flush. In this situation, the player wins because the player has an ACE which outranks each card that the dealer has in his hand. However, in accordance with the invention, the ACE may also have a numeric value of one and thus, can be used as the low card in the straight: ACE, TWO, THREE, FOUR, FIVE. In such a situation, a higher ranking straight would win since the ACE, as used in this hand, has a numeric value of one.

Figure 5:
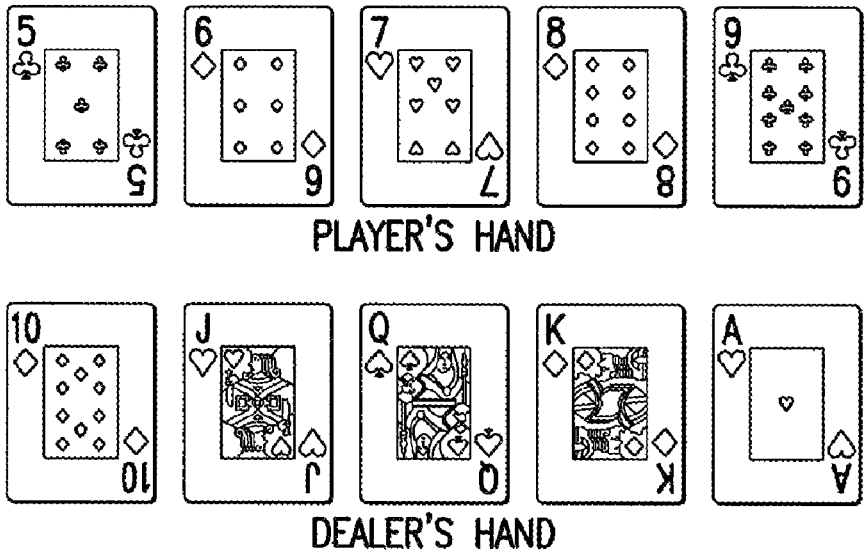
FIG. 5 illustrates a player and the dealer both having a five-card straight.
Figure 6:
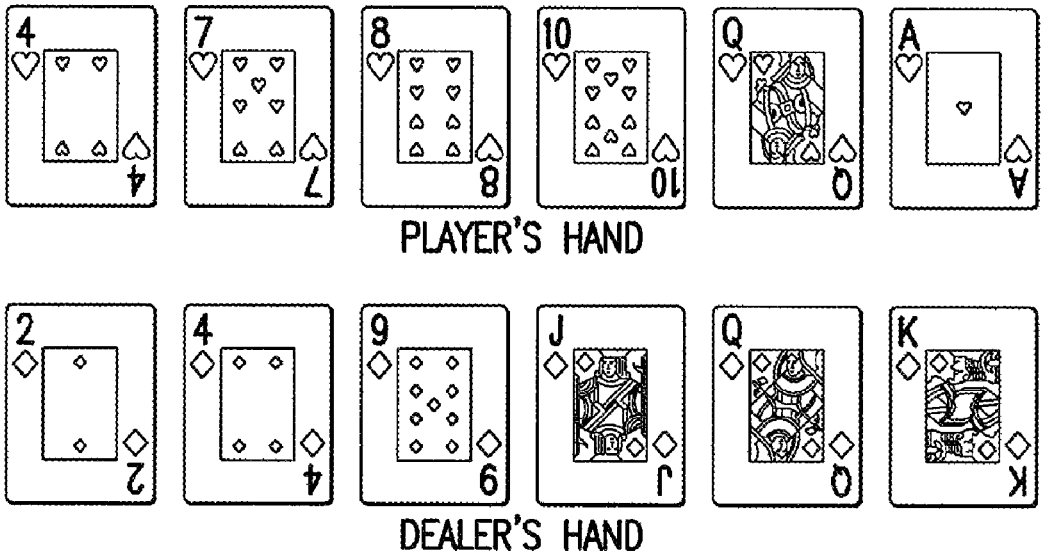
FIG. 6 illustrates a player and the dealer both having a six-card flush.
Figure 7:
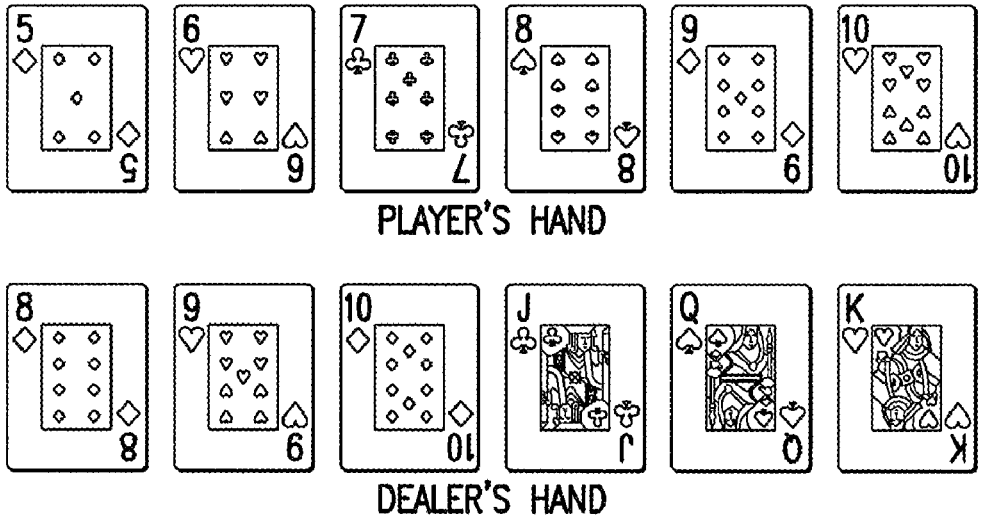
FIG. 7 illustrates a player and the dealer both having a six-card straight.
Figure 8:
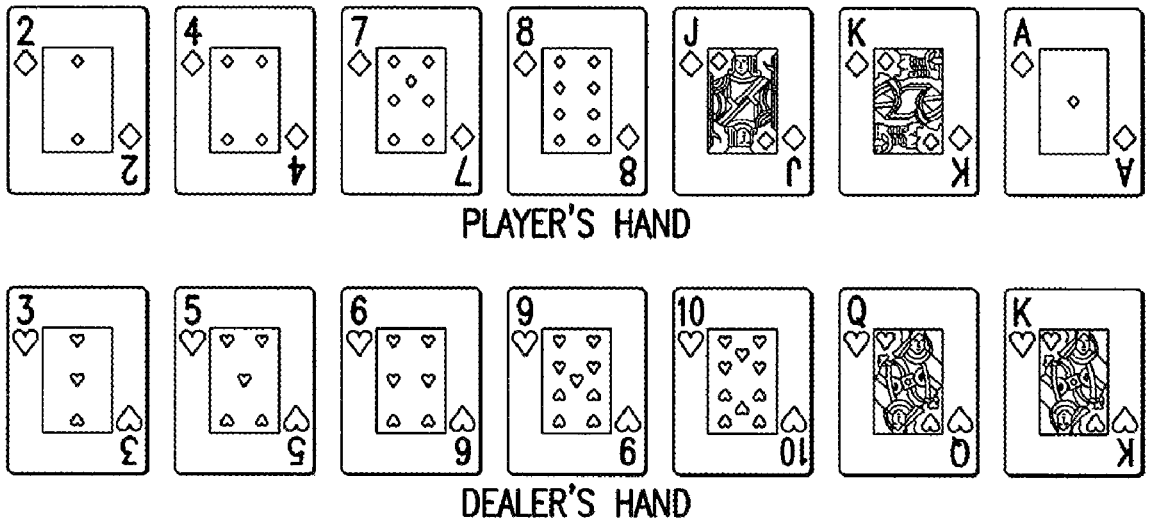
FIG. 8 illustrates a player and the dealer both having a seven-card flush.
Figure 9:
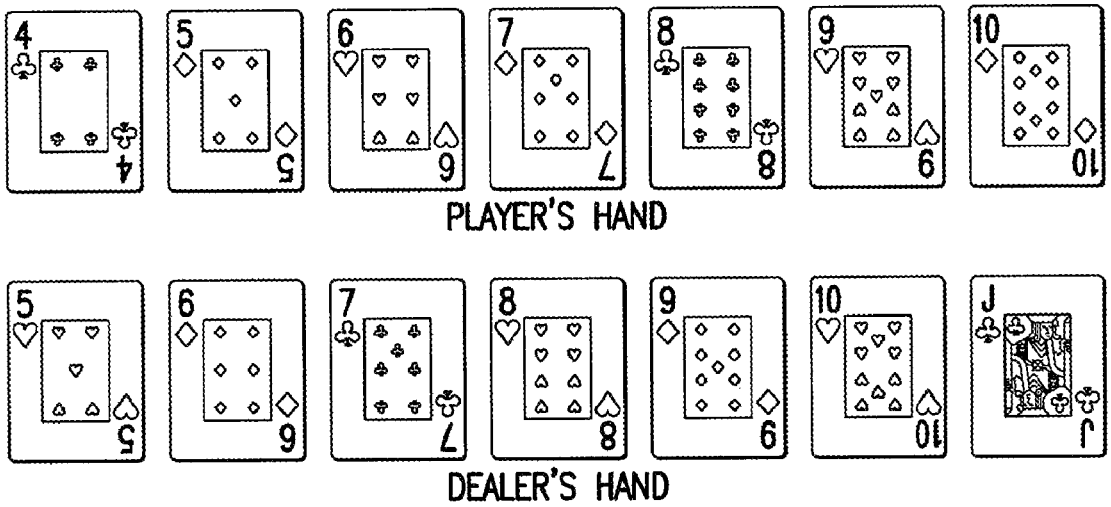
FIG. 9 illustrates a player and the dealer both having a seven-card straight.

FIG. 5 shows an example wherein the dealer and player each have a five card straight. In this situation, the dealer wins since the dealer has an ACE which outranks any of the cards the player has in his hand. FIG. 6 shows an example wherein the dealer and the player each have a six card flush. In this situation, the player wins because the player has an ACE which outranks each card that the dealer has in his hand. FIG. 7 shows an example wherein the dealer and player each have a six card straight. In this situation, the dealer wins since the dealer has a KING which outranks any of the cards the player has in his hand. FIG. 8 shows an example wherein the dealer and the player each have a seven card flush. In this situation, the player wins because the player has an ACE which outranks each card that the dealer has in his hand. FIG. 9 shows an example wherein the dealer and player each have a seven card straight. In this situation, the dealer wins since the dealer has a JACK which outranks any of the cards the player has in his hand.

In the event of a tie, then the second highest ranking card in the dealer's hand and the player's hand are used to break the tie. In the event the second highest ranking cards have the same ranking and cannot break the tie, then the third highest ranking card in the dealer's hand and the player's hand are used to break the tie. In the event the tie cannot be broken with the third highest ranking cards, this process will continue (e.g. fourth highest ranking cards, fifth highest ranking cards, etc.) until either the player or the dealer has a card that has a ranking that breaks the tie.

Table I shows the possible hands and the ranking assigned to each hand. A ranking of twelve is the highest and a ranking of one is the lowest.

TABLE I

| HAND | RANKING |
|---|---|
| Seven Card Straight-Flush | 12 |
| Seven Card Flush | 11 |
| Seven Card Straight | 10 |
| Six Card Straight-Flush | 9 |
| Six Card Flush | 8 |
| Six Card Straight | 7 |
| Five Card Straight-Flush | 6 |
| Five Card Flush | 5 |
| Five Card Straight | 4 |
| Four Card Straight-Flush | 3 |
| Four Card Flush | 2 |
| Four Card Straight | 1 |

The player's hand must beat the dealer's hand to win the Ante and the Call bet. The winning player is paid even money on the Ante. The winnings paid to the player based on the Call bet are based on the pay table shown in Table II:

TABLE II

| Winning Hand | Payout |
|---|---|
| 7 card straight-flush or flush | 30:1 |
| 7 card straight | 15:1 |
| 6 card straight-flush or flush | 10:1 |
| 6 card straight | 5:1 |
| 5 card straight, flush or straight-flush | 2:1 |
| 4 card straight, flush or straight-flush | 1:1 |

If the player ties the dealer, it is a push and the player's Ante wager and Call bet are returned to the player.

In an alternate embodiment of the wagering game of the present invention, the player only loses a portion of his Ante wager when he folds or surrenders. For example, the player would only lose half of his Ante wager and the remaining portion of the Ante wager is returned to the player.

As described in the foregoing description, the player has the option of making a Jackpot wager in addition to the Ante wager and Call wager. In a preferred embodiment, the Jackpot is a Progressive Jackpot. In one embodiment, the Progressive Jackpot requires a one-dollar Progressive Jackpot Wager. In another embodiment, the Progressive Jackpot is a 3-Pot Progressive Jackpot and requires a one-dollar 3-Pot Progressive Jackpot Wager. Each of these Progressive Jackpot bets is now discussed in detail.

One-Dollar Progressive Jackpot Bet

In this embodiment, the player has the option to place a one-dollar Progressive Jackpot bet when he or she places the Ante wager. Referring to Table III below, if the player's seven card hand matches any of the winning hands on the Progressive Jackpot paytable, the player will be paid as follows:

TABLE III

| Winning Hand | Pay |
|---|---|
| 7 Card Royal Flush | Current Jackpot ($50,000 seed) |
| 7 Card Straight Flush | $5,000 |
| 6 Card Royal Flush | $1,000 |
| 6 Card Straight Flush | $ 500 |
| 5 Card Royal Flush | $ 300 |
| 7 Card Flush | $ 200 |
| 7 Card Straight | $ 30 |
| 6 Card Flush | $ 20 |
| 6 Card Straight | $ 10 |
| 5 Card Flush | $ 5 |

In a preferred embodiment, for each one-dollar wagered by players during play of the card game of the present invention, fifty cents is allocated to the progressive Jackpot. Thus, a substantial amount of money can accumulate in the progressive Jackpot over several days if no player acquires a winning hand that will win the Jackpot.

3-Pot Progressive Jackpot Bet

In another embodiment, the player also has the option to place a one dollar 3-Pot Progressive Jackpot bet when he or she places the Ante wager. Referring to Table IV below, if the player's seven card hand matches any of the winning hands on the 3-Pot Progressive Jackpot pay-table, the player will be paid as follows:

TABLE IV

| Winning Hand | Payout |
|---|---|
| Seven Card Royal Flush | Current Gold Jackpot ($500,000 seed) |
| Seven Card Straight-Flush | $100,000 |
| Six Card Royal Flush | Current Silver Jackpot ($35,000 seed) |
| Six Card Straight-Flush | $ 7,500 |
| Five Card Royal Flush | Current Bronze Jackpot ($4,000 seed) |
| Five Card Straight-Flush | $ 500 |

Figure 10:
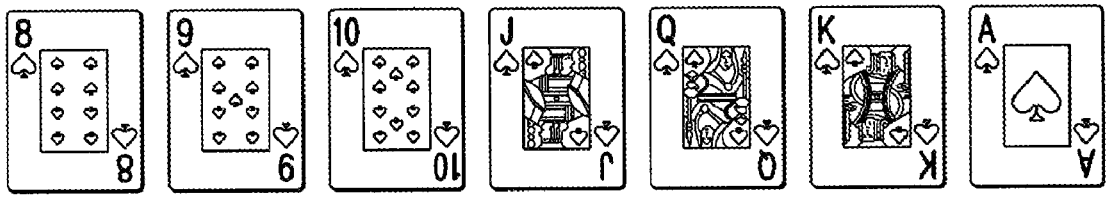
FIG. 10 illustrates a hand of cards that yields a seven card royal flush which would qualify as a winning hand for purposes of a progressive Jackpot.

FIG. 10 illustrates an example of a seven card royal flush.

All progressive Jackpot wagers are collected regardless of whether or not a player wins the progressive Jackpot.

In accordance with this embodiment of the Progressive Jackpot, a player's hand is evaluated in the order listed in the pay table shown as Table IV. For example, if the Current Silver Jackpot is greater than $100,000 and the player has a seven card straight-flush that contains a six card royal flush, then the player will be paid $100,000 instead of the Current Silver Jackpot. A predetermined portion of every one-dollar wagered is allocated to each of the three Jackpots: Current Gold Jackpot, Current Silver Jackpot and Current Bronze Jackpot. In one embodiment, the allocation is shown in Table V:

TABLE V

| | |
|---|---|
| Gold Jackpot | 22 cents |
| Silver Jackpot | 8 cents |
| Bronze Jackpot | 8 cents |
| Total | 38 cents |

The card game of the present invention can be played: (i) in a casino or other wagering establishment in a manner similar to conventional card games, i.e. "live table version" wherein a group of players and a dealer are positioned at a gaming table, (ii) on electronic video gaming machines such as electronic video poker gaming machines which may be located in a casino other wagering establishment, or (iii) on linked, electronic video gaming machines located in a casino or wagering establishment. Electronic video gaming machines are generally described in U.S. Pat. Nos. 5,823,873, 6,478,675 and 6,517,074, the disclosures of which patents are hereby incorporated by reference. The card game of the present invention also can be implemented on slot machines. Furthermore, the card game of the present invention also can be implemented with lottery scratch-type tickets that are sold by many state governments.

Figure 11:
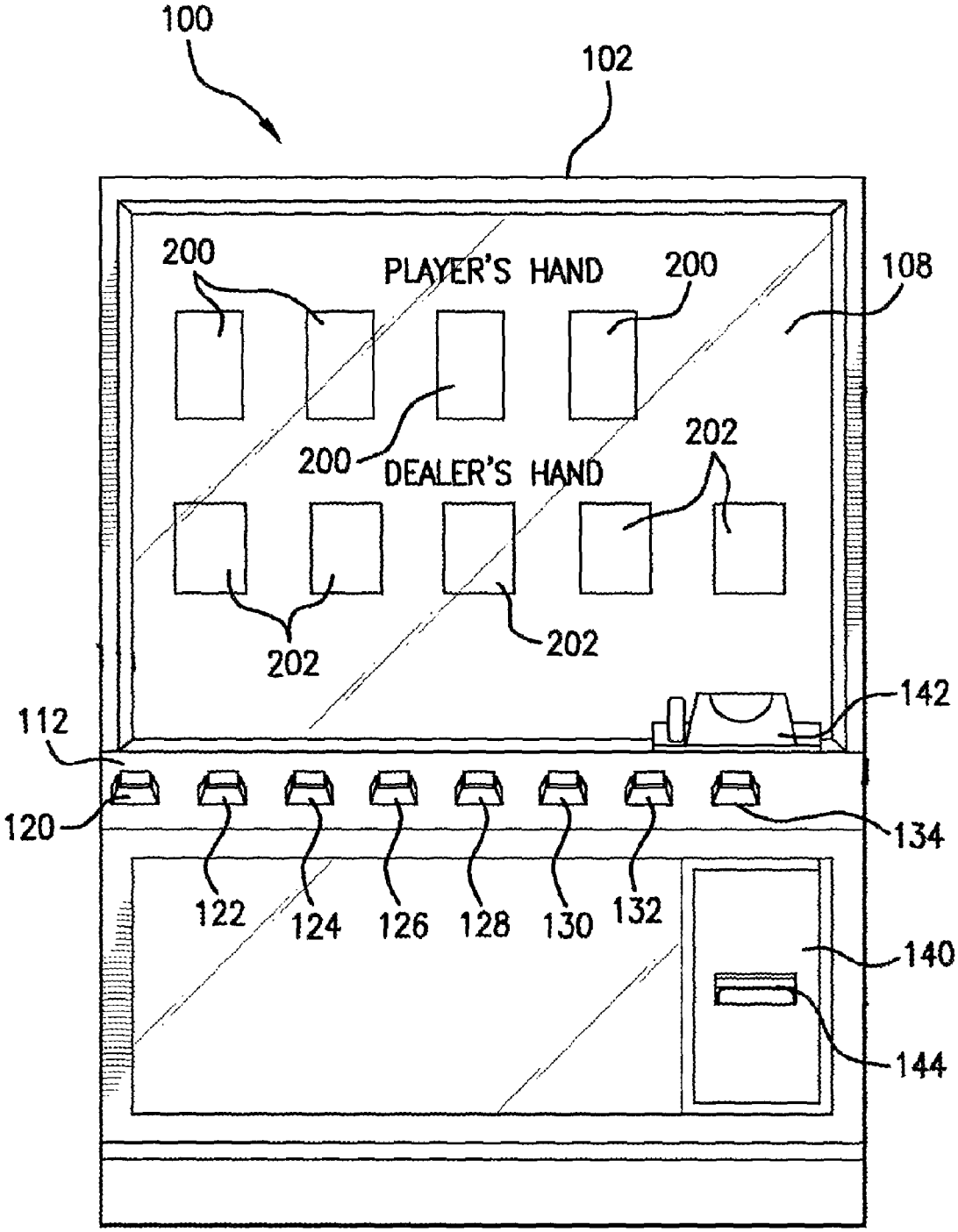
FIG. 11 is a diagram of an electronic video gaming machine on which the card game of the present invention may be played.
Figure 12:
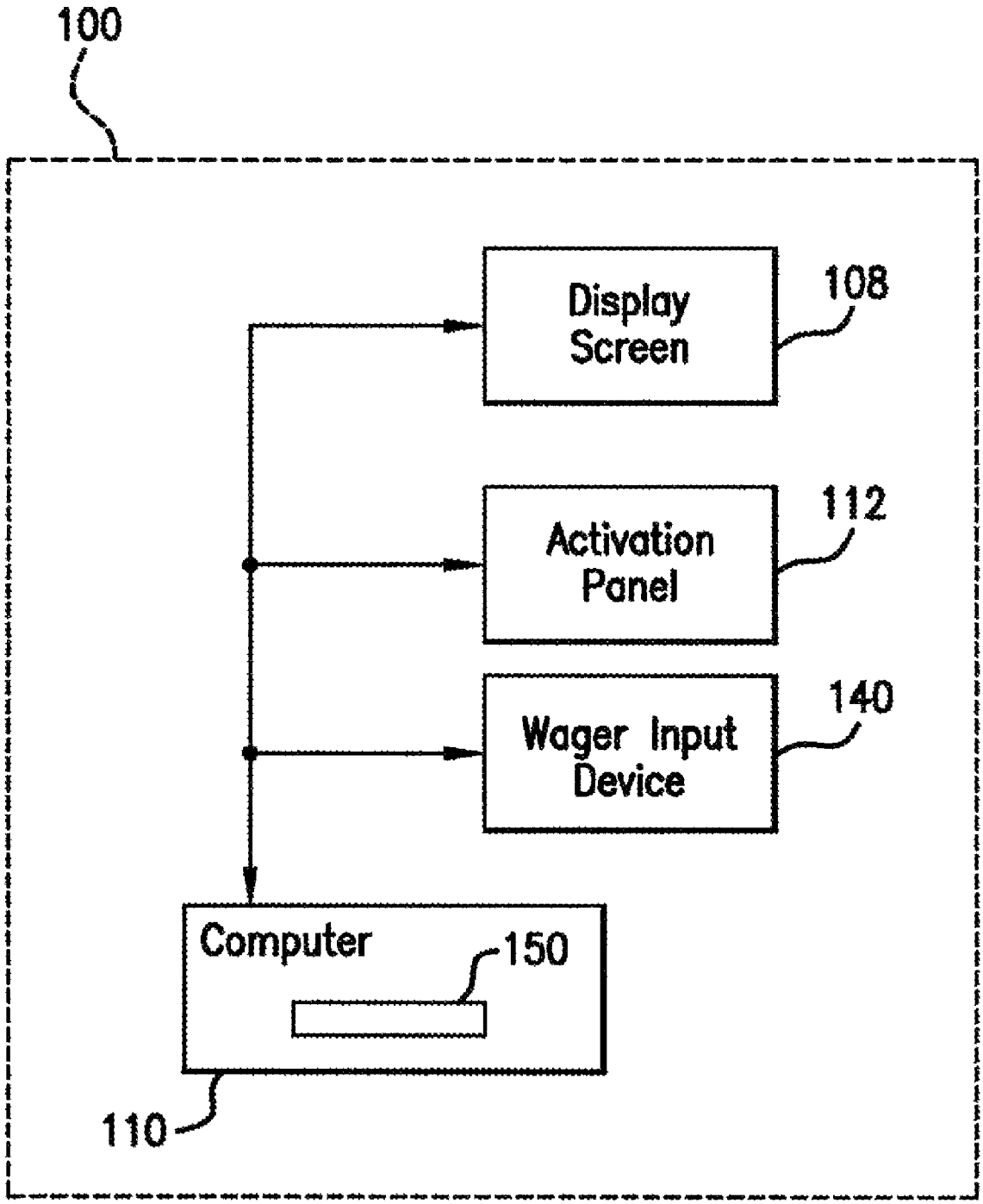
FIG. 12 is a Nock diagram of the interconnection of the main components of the electronic video gaming machine of FIG. 11.

Referring to FIGS. 11 and 12, there is shown a diagram of an electronic video gaming machine 100 on which the card game of the present invention may be played. Electronic gaming machine 100 comprises video screen display 108, computer 110 and activation panel 112. Computer 110 is in electronic data signal communication with video screen display 108 and activation panel 112. Video screen display 108 displays the playing cards that will be used during the play of the card game. Thus, video screen display 108 displays the player's hand of cards 200 and also displays the dealer's hand of cards 202. Video screen display 108 also displays other information and data to the player to allow the player to understand the play of the game and the progress of the game. Video screen display 108 also displays information related to the winner of the game (e.g. dealer or player) and the amount of any winnings to be awarded to the player. Activation panel 112 comprises a button panel which has buttons 120, 122, 124, 126, 128, 130, 132 and 134 that the player may press to activate various actions during play of the card game. An "ANTE" button 122 allows the player to place the initial Ante and start the game. "CALL WAGER" button 124 allows the player to place his Call Wager. Electronic video gaming machine 100 further comprises wager input device 140 that comprises two portions. The first portion is coin slot 142 which allows the player to insert coins or tokens. The second portion of wager input device 140 is device 144 which is configured to accept bills, vouchers, coupons, or other suitable script. Wager input device 140 includes electronic circuitry, well known in the art, which generates electronic data signals representing the amount and type of wager. These electronic data signals are inputted into computer 110. Computer 110 stores therein a video signal representation of each card of a standard deck of cards. Computer 110 analyzes the displayed hands of cards. As shown in FIG. 12, computer 110 comprises a processor device 150 which has a non-transitory computer readable medium encoded with instructions. Processor device 150 executes these instructions to perform the steps of the card game of the present invention. Electronic data representing each card in a deck of playing cards is stored in the memory of computer 110. Computer 110 also comprises other electronic circuits such as cache memory, signal processing circuits and driver circuitry which are known in the art. Processor 150 is programmed with a predetermined pay-out table or pay schedule. Computer 110 implements many functions such as randomly shuffling a deck (or decks) of cards and analyzing the displayed hands of cards held by the dealer and the player.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

What is claimed is:

1. A method of operating an electronic video gaming machine to play a card game thereon comprising the steps of:

providing an electronic video gaming machine comprising a video screen display, means for allowing a player to activate various actions during play of the card game, a device for receiving a player's wager or bet, a computer for storing therein a video signal representation of each card of a standard deck of cards and for analyzing displayed hands of cards, and a non-transitory computer readable medium encoded with instructions and executed by a processor to perform the steps of:

each player inputting an ante wager into the electronic video gaming machine in order to participate in the wagering game;

displaying on the video display screen a deal consisting of four cards face down to each player who places the ante wager to form a player hand;

displaying on the video display screen a deal consisting of four cards face down to the dealer to form a dealer hand;

displaying on the video display screen the player's cards so that the player may decide whether to continue play or to surrender, wherein any player deciding to surrender shall fold and forfeit that player's ante wager;

each remaining player inputting a call wager into the electronic video gaming machine in order to continue to play the wagering game;

displaying on the video display screen a deal consisting of three additional cards face down to each remaining player who places a call wager so that each player can form a seven card hand;

displaying on the video display screen a deal consisting of three additional cards face down to the dealer so that the dealer can form a seven card hand;

analyzing the players' hand to determine if any player does not have at least a four card straight, a four card flush or a four card straight-flush, requiring such player to forfeit that player's ante wager and declaring a push with respect to the player's call wager;

each player having at least a four card straight-flush, a four card flush or a four card straight playing against the dealer's hand;

analyzing the dealer's hand to determine the ranking of the dealer's hand and the player's hand in accordance with the following ranking of hands consisting of:

| HAND | RANKING |
|---|---|
| Seven Card Straight-Flush | 12 |
| Seven Card Flush | 11 |
| Seven Card Straight | 10 |
| Six Card Straight-Flush | 9 |
| Six Card Flush | 8 |
| Six Card Straight | 7 |
| Five Card Straight-Flush | 6 |
| Five Card Flush | 5 |
| Five Card Straight | 4 |
| Four Card Straight-Flush | 3 |
| Four Card Flush | 2 |
| Four Card Straight | 1 |

wherein the highest ranking is 12 and the lowest ranking is 1;

analyzing the player's hand to determine if the player's hand outranks the dealer's hand;

paying each player winnings on the ante and call wagers when the player's hand outranks the dealer's hand in accordance with a pay-table consisting of the following winning player's hand ranking of:

| Winning Hand | Payout Ranking |
|---|---|
| 7 card straight-flush or flush | 6 (Highest payout) |
| 7 card straight | 5 |
| 6 card straight-flush or flush | 4 |
| 6 card straight | 3 |
| 5 card straight, flush or straight-flush | 2 |
| 4 card straight, flush or straight-flush | 1 (Lowest Payout) |

wherein a Payout Ranking of "6" represents the highest payout and a Payout Ranking of "1" represents the lowest payout; and collecting the ante and call wagers from the players whose hands do not outrank the dealer's hand.

2. The method of operating an electronic video gaming machine to play a card game thereon according to claim 1 wherein the step of each player inputting an ante wager includes the steps of providing each player an opportunity to input a Jackpot wager and each player inputting the Jackpot wager into the electronic video gaming machine.

3. The method of operating an electronic video gaming machine to play a card game thereon according to claim 1 wherein the call wager is equal to the ante wager.

4. The method of operating an electronic video gaming machine to play a card game thereon according to claim 1 wherein the call wager is double the ante wager.

5. The method of operating an electronic video gaming machine to play a card game thereon according to claim 1 wherein in the step of paying winnings to each player on the player's ante and call wagers, such winnings are based on the following table of payout rankings and corresponding payout ratios:

| Payout Ranking | Payout Ratio |
|---|---|
| 6 | 30:1 |
| 5 | 15:1 |
| 4 | 10:1 |
| 3 | 5:1 |

-continued

| Payout Ranking | Payout Ratio |
|---|---|
| 2 | 2:1 |
| 1 | 1:1 |

* * * * *